US009297597B2

(12) United States Patent
Huang

(10) Patent No.: US 9,297,597 B2
(45) Date of Patent: Mar. 29, 2016

(54) COMBINATION HEAT SINK ASSEMBLY

(71) Applicant: Tsung-Hsien Huang, I-Lan Hsien (TW)

(72) Inventor: Tsung-Hsien Huang, I-Lan Hsien (TW)

( * ) Notice: Subject to any disclaimer, the term of this patent is extended or adjusted under 35 U.S.C. 154(b) by 230 days.

(21) Appl. No.: 14/159,034

(22) Filed: Jan. 20, 2014

(65) Prior Publication Data

US 2015/0136363 A1 May 21, 2015

(30) Foreign Application Priority Data

Nov. 18, 2013 (CN) ..... 2013 1 0573498

(51) Int. Cl.
*F28F 13/00* (2006.01)
*F28D 15/04* (2006.01)
*H01L 23/467* (2006.01)

(52) U.S. Cl.
CPC ..... *F28F 13/00* (2013.01); *F28D 15/04* (2013.01); *F28F 2215/00* (2013.01)

(58) Field of Classification Search
CPC ..... B21D 53/02; F28F 3/06; F28F 3/02; F28F 1/30; F28F 1/32; F28F 2275/122; F28D 15/0275; H01L 21/4878; H01L 23/3672
USPC ..... 165/185, 80.3
See application file for complete search history.

(56) References Cited

U.S. PATENT DOCUMENTS 5,014,776 A 5/1991 Hess
6,009,937 A * 1/2000 Gonner ..... F28F 3/02 165/185
6,176,304 B1 * 1/2001 Lee ..... F28F 3/025 165/185
2003/0094275 A1 * 5/2003 Mochizuki ..... F28F 3/02 165/185
2007/0051495 A1 * 3/2007 Hsiao ..... F28F 3/02 165/80.3
2009/0145580 A1 * 6/2009 Lin ..... H01L 23/3672 165/80.3
2009/0194255 A1 * 8/2009 Huang ..... G06F 1/20 165/80.3
2011/0168374 A1 * 7/2011 Watanabe ..... H01L 21/4882 165/185
2013/0043012 A1 * 2/2013 Chen ..... H01L 23/467 165/181
2013/0206381 A1 * 8/2013 Huang ..... F28D 15/0275 165/185

* cited by examiner

*Primary Examiner* — Tho V Duong
(74) *Attorney, Agent, or Firm* — Pai Patent & Trademark Law Firm; Chao-Chang David Pai

(57) ABSTRACT

A heat sink assembly includes a heat transfer block defining alternatively arranged mounting grooves and spacer ribs, and radiation fins respectively formed by bending one respective thin metal sheet member into a substantially inverted U-shaped profile having two radiation fin walls that have one end connected to each other and an opposite end terminating in a respective outwardly upwardly extending folded portion, each radiation fin wall with the respective outwardly upwardly extending folded portion being inserted into one respective mounting groove of the heat transfer block and fixedly secured thereto through a stamping operation to deform the folded portions of the radiation fin walls of the radiation fins and spacer ribs of the heat transfer block synchronously.

9 Claims, 7 Drawing Sheets

COMBINATION HEAT SINK ASSEMBLY

BACKGROUND OF THE INVENTION (a) Field of the Invention

The present invention relates to heat sink technology and more particularly to a heat sink assembly, which comprises a heat transfer block defining a plurality of mounting grooves, and a plurality of radiation fins having a substantially inverted U-shaped profile and affixed to the mounting grooves through a stamping process.

(b) Description of the Prior Art

Conventional heat sinks generally comprise a heat transfer block and a plurality of radiation fins. These radiation fins can be directly welded to the heat transfer block. Alternatively, the heat transfer block can be configured to provide mounting grooves for the mounting of the radiation fins. After the radiation fins are inserted into the respective mounting grooves, a stamping process is performed to deform a part of the heat transfer block, enabling the radiation fins to be affixed to the heat transfer block. For example, U.S. Pat. No. 5,014,776 discloses a heat sink design, entitled "Heat emitting unit in form of a heater or cooler", which achieves fixation between radiation fins and heat transfer block by deforming two opposite side walls of each mounting groove of the heat transfer block.

According to the aforesaid prior art design, ribs (radiation fins) are inserted into channels of a heat transfer block and are pressed into place through deformation of intermediary ridges. However, because these ribs (radiation fins) are planar sheet members, their heat dissipation surface area is limited and are often unable to provide sufficient heat dissipation of the heat sink.

BRIEF SUMMARY OF THE INVENTION

The present invention has been accomplished under the circumstances in view. It is the main object of the present invention to provide a heat sink assembly, which comprises a heat transfer block having alternatively arranged mounting grooves and spacer ribs, and a plurality of radiation fins affixed to the mounting grooves of the heat transfer block by stamping. Each radiation fin comprises two radiation fin walls each having one end thereof connected to each other and an opposite end thereof terminating in a respective outwardly upwardly extending folded portion. Each radiation fin wall with the respective outwardly upwardly extending folded portion are inserted into one respective mounting groove, and then fixedly secured thereto through a stamping operation to deform the folded portions of the radiation fin walls of the radiation fins and the spacer ribs of the heat transfer block synchronously.

Further, the spacer ribs rise above respective groove walls of the mounting grooves, defining an elevational difference between the spacer ribs and the groove walls of the mounting grooves. Further, each spacer rib comprises a deformation groove and two protrusions at two opposite lateral sides of the deformation groove. The protrusions are synchronously deformed during the stamping operation to deform the folded portions of the radiation fin walls of the radiation fins and the spacer ribs of the heat transfer block.

Further, the protrusions of the spacer ribs rise above the folded portions of the radiation fin walls of the radiation fins in the mounting grooves of the heat transfer block, and are turned into respective deformed portions after the stamping operation to deform the folded portions of the radiation fin walls of the radiation fins and the spacer ribs of the heat transfer block. Further, the deformed portions are downwardly and tightly abutted against the respective folded portions of the radiation fin walls of the radiation fins.

Further, the folded portion of each radiation fin wall of each radiation fin is partially turned into a squeezed portion after the stamping operation. The squeezed portion is horizontally abutted against the folded portion of one respective radiation fin wall.

Preferably, the heat transfer block further comprises at least one locating groove located on one side thereof opposite to the mounting grooves and the radiation fins, and a heat pipe press-fitted into each locating groove in a flush manner.

Further, the heat transfer block can be a rectangular block. Alternatively, the heat transfer block can be a circular block defining a circular periphery. In this case, the mounting grooves are vertically located on and equally spaced around the circular periphery of the heat transfer block. Further, the radiation fins are affixed to the mounting grooves and radially arranged around the circular periphery of the heat transfer block.

DETAILED DESCRIPTION OF THE PREFERRED EMBODIMENTS

Figure 1:
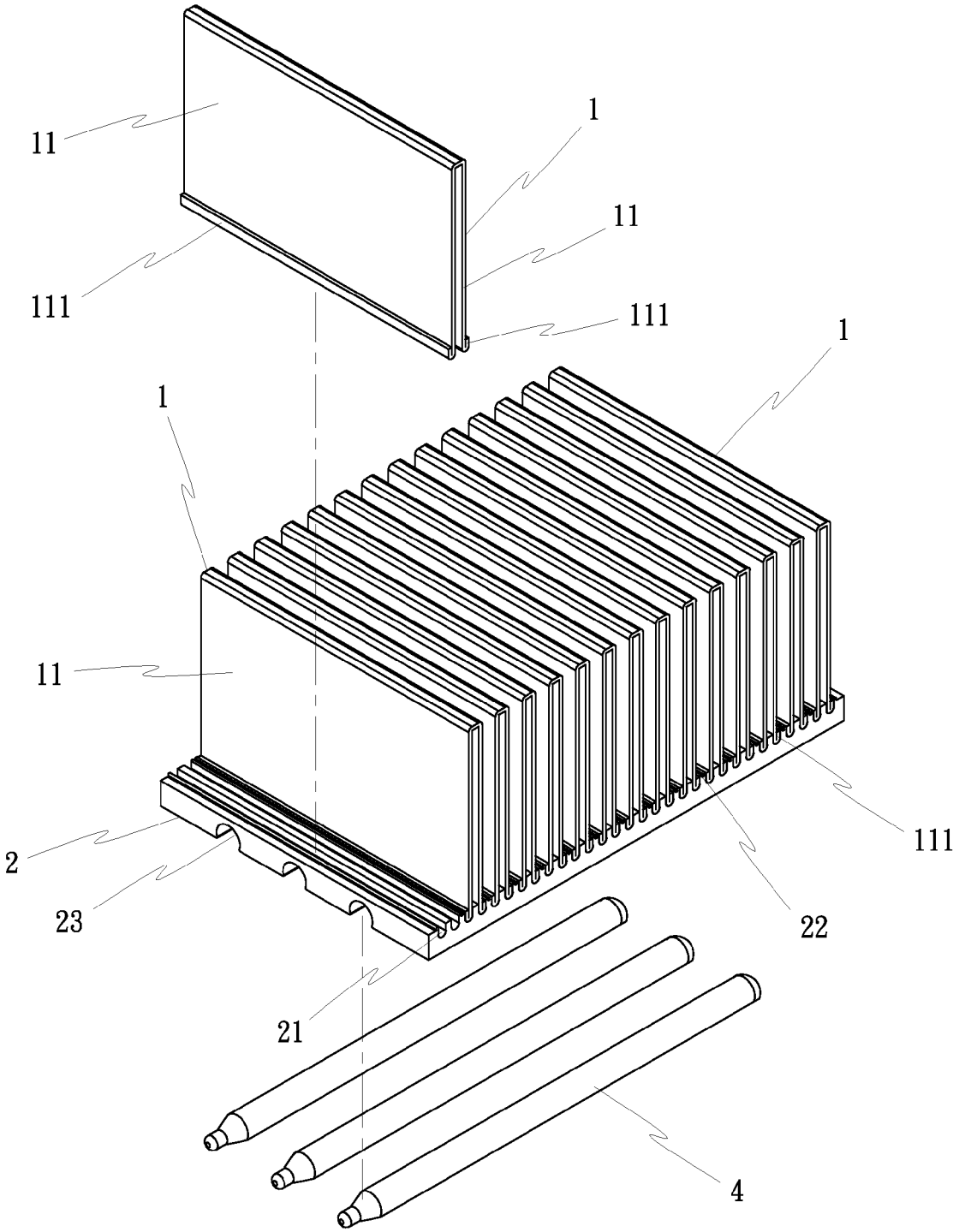
FIG. 1 is an exploded view of a combination heat sink assembly in accordance with the present invention.

Referring to FIG. 1, a combination heat sink assembly in accordance with the present invention is shown. As illustrated, the combination heat sink assembly comprises a plurality of radiation fin 1 and a heat transfer block 2.

Figure 2:
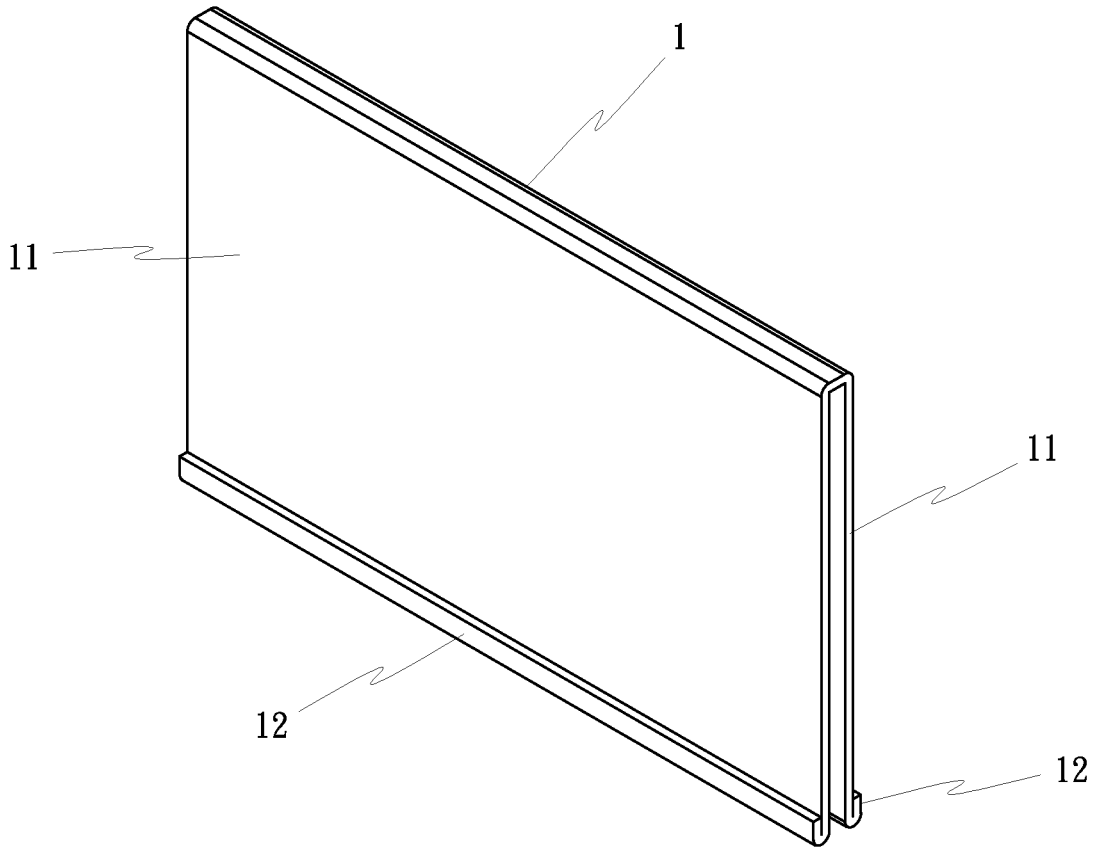
FIG. 2 is an elevational view of one radiation fin of the combination heat sink assembly in accordance with the present invention.

The radiation fins 1, as shown in FIG. 2, are formed by bending one respective thin metal sheet member into a substantially inverted U-shaped profile, each comprising two radiation fin walls 11. The two radiation fin walls 11 each have one end thereof connected to each other and an opposite end terminating in a respective outwardly upwardly extending folded portion 111.

The heat transfer block 2 comprises a plurality of mounting grooves 21 located on a top wall thereof for the mounting of the radiation fin walls 11 of the radiation fins 1, and a spacer rib 22 disposed between each two adjacent mounting grooves 21. After the radiation fin walls 11 of the radiation fins 1 are inserted into the respective mounting grooves 21, punches 3 are used to stamp against the folded portions 111 of the radiation fin walls 11 and the spacer ribs 22 of the heat transfer block 2 (see FIG. 3) to deform the folded portions 111 and the spacer ribs 22 synchronously, and thus the radiation fins 1 are affixed to the heat transfer block 2 (see FIG. 4).

Figure 3:
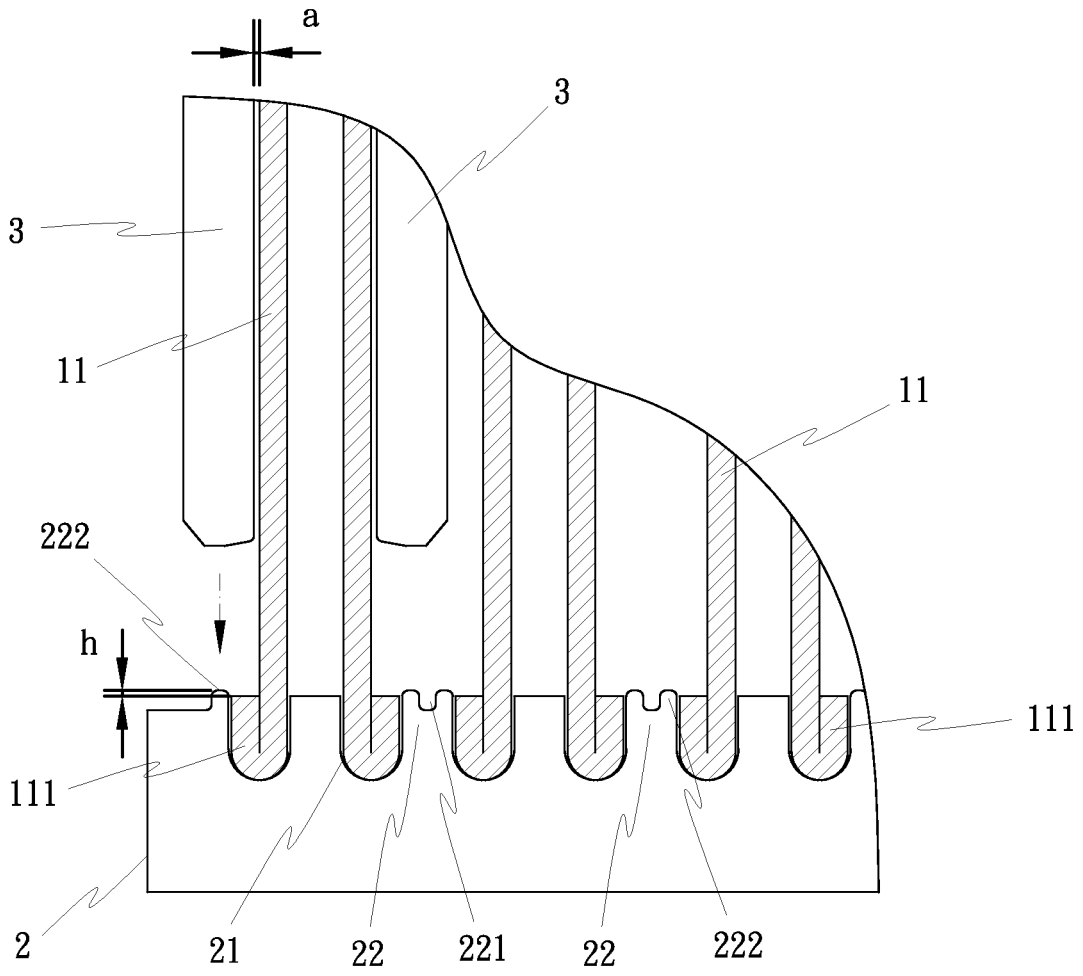
FIG. 3 is a schematic sectional view of the present invention illustrating the positioning of the radiation fin walls of the radiation fins in the respective mounting grooves of the heat transfer block before stamping.

As shown in FIG. 3, before the stamping, the spacer ribs 22 rise above the groove walls of the mounting grooves 21 (see the elevational difference h). Each spacer rib 22 is configured to provide a deformation groove 221 on the middle so that two protrusions 222 are defined at two opposite lateral sides of the deformation groove 221. When stamping the punches 3 against the folded portions 111 of the radiation fin walls 11 and the spacer ribs 22 of the heat transfer block 2, the folded portions 111 of the radiation fin walls 11 of the radiation fins 1 and the deformation grooves 221 and protrusions 222 of the spacer ribs 22 of the heat transfer block 2 are synchronously deformed, thus enhancing the connection tightness between the radiation fins 1 and the heat transfer block 2 (see FIG. 4).

Figure 4:
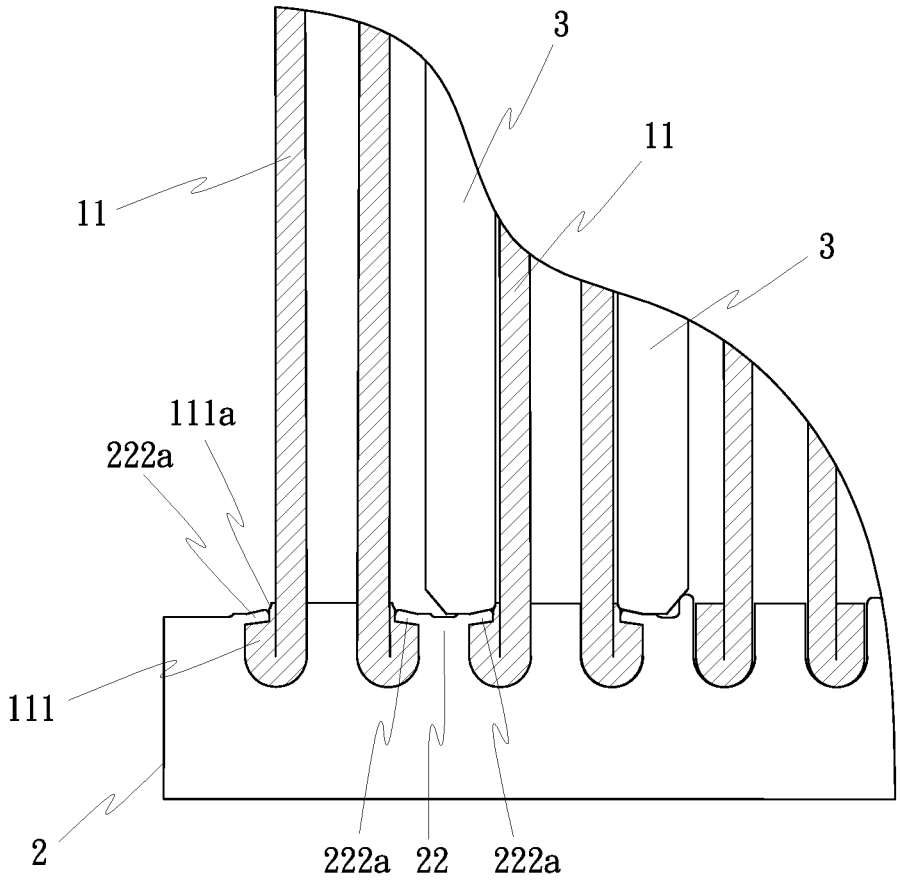
FIG. 4 corresponds to FIG. 3, illustrating the outwardly upwardly extending folded portions of the radiation fin walls of the radiation fins and the spacer ribs of the heat transfer block after being deformed by stamping.
Figure 5:
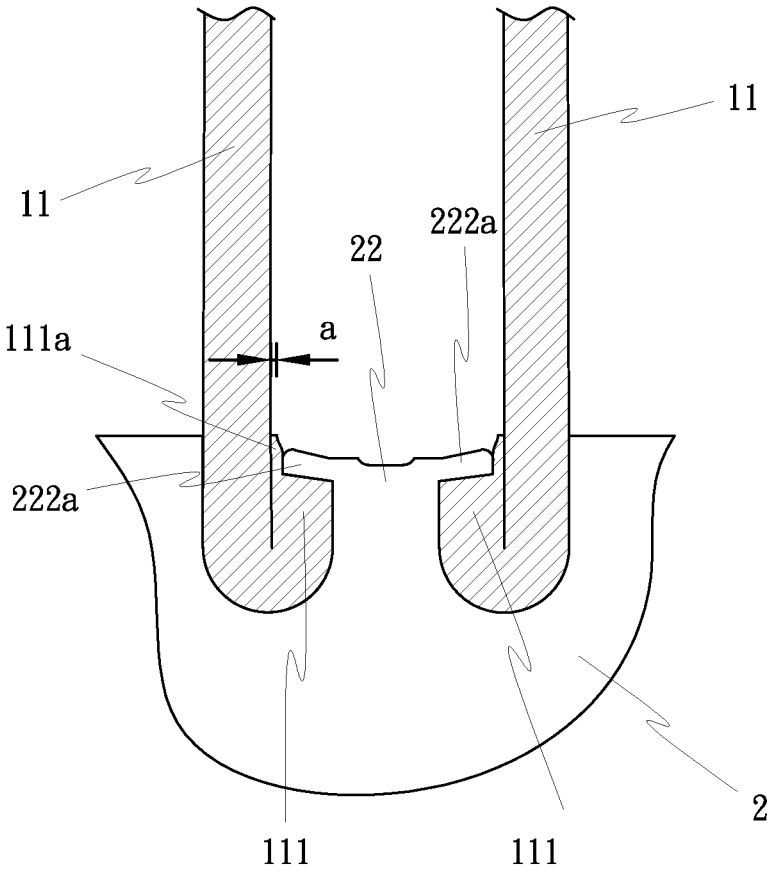
FIG. 5 is an enlarged view of a part of FIG. 4.

As shown in FIG. 4, the protrusions 222 rise above the folded portions 111 in the mounting grooves 21. After being stamped by the punches 3, the protrusions 222 of the spacer ribs 22 are turned into respective deformed portions 222*a* that are downwardly and tightly abutted against the respective folded portions 111 to give them a downward pressure, preventing displacement of the radiation fin walls 11 of the radiation fins 1 relative to the heat transfer block 2. Further, there is a clearance a left between each punch 33 and each adjacent radiation fin wall 11 (see FIG. 3), thus the folded portion 111 of each radiation fin wall 11 is partially turned into a squeezed portion 111*a* (see FIG. 5) after the stamping operation, causing each deformed portion 222*a* to impart a horizontal pressure to the folded portion 111 of the adjacent radiation fin wall 11. This feature further enhances the connection stability between the radiation fin walls 11 of the radiation fins 1 and the heat transfer block 2.

Figure 6:
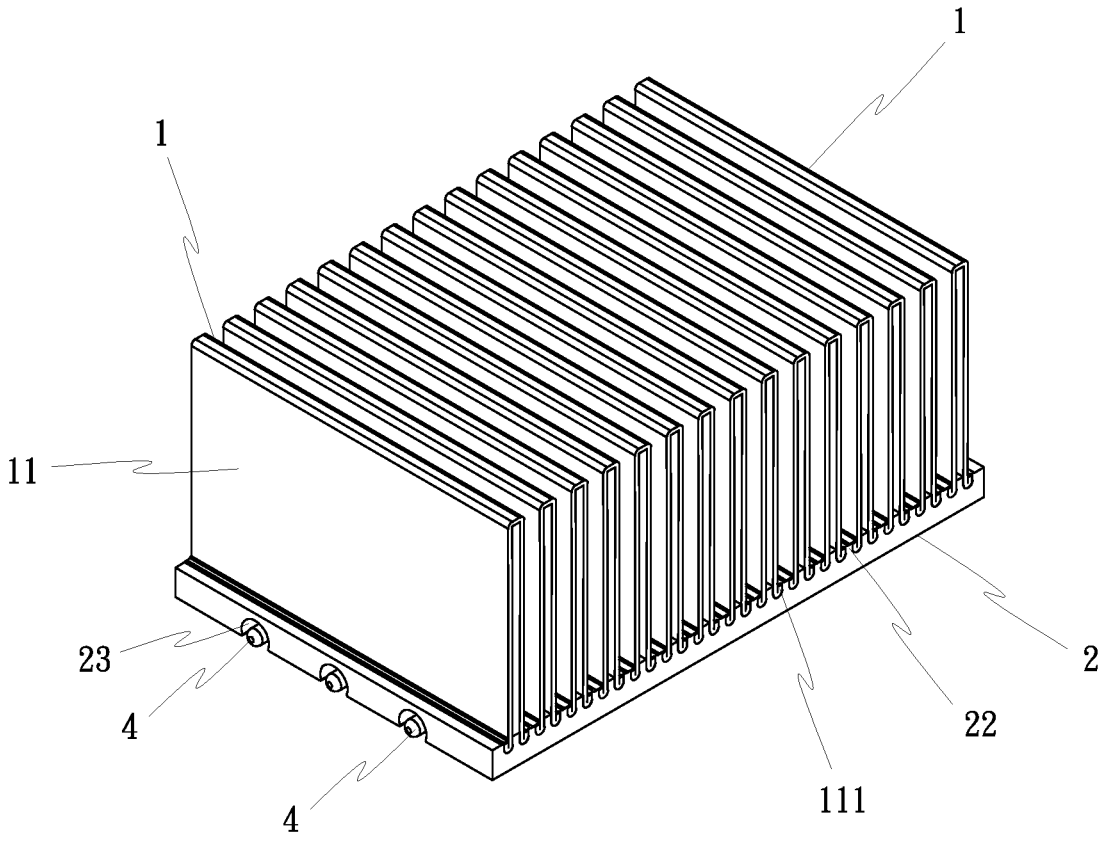
FIG. 6 is an oblique top elevational view of the combination heat sink assembly shown in FIG. 1.

Referring to FIG. 6 and FIG. 1 again, the heat transfer block 2 further comprises at least one or multiple locating grooves 23 at an opposing bottom wall thereof. Further, heat pipes 4 are respectively press-fitted into the locating grooves 23 and kept in flush with the bottom wall of the heat transfer block 2.

Figure 7:
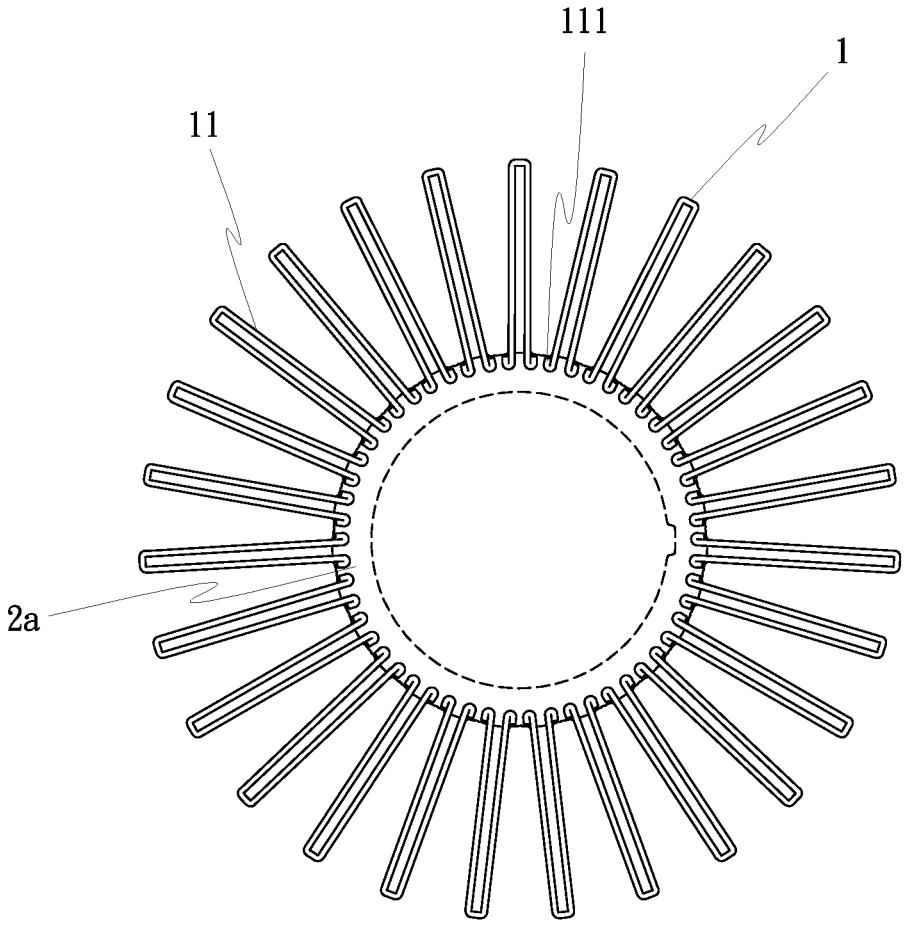
FIG. 7 is a top view of an alternate form of the present invention, illustrating the use of a circular heat transfer block.

Further, according to different application requirements, the heat transfer block 2 can be made in a rectangular shape (see FIG. 6) or circular shape (see FIG. 7). In the rectangular example shown in FIG. 6, the mounting grooves 21 are arranged in parallel on the rectangular top wall of the rectangular heat transfer block 2 for securing the radiation fins 1 in a parallel manner. In the circular example shown in FIG. 7, the mounting grooves are vertically located on and equally spaced around the circular periphery of the circular heat transfer block 2*a* for securing the radiation fins 1 in a radial manner.

In conclusion, the invention provides a combination heat sink assembly, which comprises a heat transfer block 2 defining a plurality of mounting grooves 21, and a plurality of radiation fins 1 each comprising two radiation fin walls 11 that have a respective one end connected to each other and a respective opposite end terminating in a respective outwardly upwardly extending folded portion 111, wherein the radiation fin walls 11 of the radiation fins 1 with the respective outwardly upwardly extending folded portions 111 are respectively inserted into the mounting grooves 21 of the heat transfer block 2 and then fixedly connected thereto through a stamping process.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A heat sink assembly, comprising:

a heat transfer block comprising a plurality of mounting grooves located on an outer surface thereof and a spacer rib disposed between each two adjacent said mounting grooves; and a plurality of radiation fins affixed to said mounting grooves of said heat transfer block, each said radiation fin comprising two radiation fin walls, said two radiation fin walls each having one end thereof connected to each other and an opposite end thereof terminating in a respective outwardly upwardly extending folded portion, each said radiation fin wall with the respective said outwardly upwardly extending folded portion being inserted into one respective said mounting groove and fixedly secured thereto through a stamping operation to deform the folded portions of said radiation fin walls of said radiation fins and said spacer ribs of said heat transfer block synchronously.

2. The heat sink assembly as claimed in claim 1, wherein said spacer ribs rise above respective groove walls of said mounting grooves, defining an elevational difference between said spacer ribs and said groove walls of said mounting grooves.

3. The heat sink assembly as claimed in claim 1, wherein each said spacer rib comprises a deformation groove and two protrusions at two opposite lateral sides of said deformation groove, said protrusions being synchronously deformed during said stamping operation to deform the folded portions of said radiation fin walls of said radiation fins and said spacer ribs of said heat transfer block.

4. The heat sink assembly as claimed in claim 3, wherein said protrusions of said spacer ribs rise above said folded portions of said radiation fin walls of said radiation fins in said mounting grooves of said heat transfer block, and are turned into respective deformed portions after said stamping operation to deform the folded portions of said radiation fin walls of said radiation fins and said spacer ribs of said heat transfer block, said deformed portions being downwardly and tightly abutted against the respective said folded portions of said radiation fin walls of said radiation fins.

5. The heat sink assembly as claimed in claim 1, wherein the folded portion of each said radiation fin wall of each said radiation fin is partially turned into a squeezed portion after said stamping operation, said squeezed portion being horizontally abutted against the folded portion of one respective said radiation fin wall.

6. The heat sink assembly as claimed in claim 1, wherein said heat transfer block further comprises at least one locating groove located on one side thereof opposite to said mounting grooves and said radiation fins, and a heat pipe press-fitted into each said locating groove in a flush manner.

7. The heat sink assembly as claimed in claim 1, wherein said heat transfer block is a rectangular block.

8. The heat sink assembly as claimed in claim 1, wherein said heat transfer block is a circular block defining a circular periphery; said mounting grooves are vertically located on and equally spaced around the circular periphery of said heat transfer block; and said radiation fins are affixed to said mounting grooves and radially arranged around the circular periphery of said heat transfer block.

9. The heat sink assembly as claimed in claim 1, wherein said radiation fins have a substantially inverted U-shaped profile.

* * * * *